US012228141B2

(12) United States Patent
Hayashi et al.

(10) Patent No.: US 12,228,141 B2
(45) Date of Patent: Feb. 18, 2025

(54) MULTI-BLADE CENTRIFUGAL AIR-SENDING DEVICE

(71) Applicant: Mitsubishi Electric Corporation, Tokyo (JP)

(72) Inventors: Hiroyasu Hayashi, Tokyo (JP); Takuya Teramoto, Tokyo (JP); Ryo Horie, Tokyo (JP); Takashi Yamaguchi, Tokyo (JP); Tomohiro Nagano, Tokyo (JP); Kazuya Michikami, Tokyo (JP); Takahiro Yamatani, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 11 days.

(21) Appl. No.: 18/023,831

(22) PCT Filed: Oct. 23, 2020

(86) PCT No.: PCT/JP2020/039891
§ 371 (c)(1),
(2) Date: Feb. 28, 2023

(87) PCT Pub. No.: WO2022/085174
PCT Pub. Date: Apr. 28, 2022

(65) Prior Publication Data

US 2023/0243365 A1 Aug. 3, 2023

(51) Int. Cl.
*F04D 29/28* (2006.01)
*F04D 29/42* (2006.01)

(52) U.S. Cl.
CPC ..... *F04D 29/281* (2013.01); *F04D 29/4226* (2013.01)

(58) Field of Classification Search
CPC ..... F04D 29/281; F04D 29/28; F04D 29/4226
See application file for complete search history.

(56) References Cited

U.S. PATENT DOCUMENTS 10,100,839 B2 * 10/2018 Kasahara ..... F04D 29/283
10,118,502 B2 * 11/2018 Yokote ..... H01M 10/663
(Continued)

FOREIGN PATENT DOCUMENTS

CN 101270763 A 9/2008
CN 105683585 A 6/2016
(Continued)

OTHER PUBLICATIONS

Office Action dated Sep. 5, 2023 issued in corresponding JP Patent Application No. 2022-556345 (and English translation).
(Continued)

*Primary Examiner* — Courtney D Heinle
*Assistant Examiner* — Andrew Thanh Bui
(74) *Attorney, Agent, or Firm* — Posz Law Group, PLC

(57) ABSTRACT

A multi-blade centrifugal air-sending device includes a fan including a back plate having a disk shape, a plurality of blades arranged at a peripheral portion of the back plate in a circumferential direction, and a rim having an annular shape and coupling the plurality of blades to each other, the plurality of blades being connected at respective first end portions on one side to the back plate, the rim being provided at respective second end portions of the plurality of blades on a side opposite to the one side where the respective first end portions are present; and a scroll casing having a spiral shape and including a facing side wall where an air inlet is provided and a peripheral wall, the scroll casing housing the fan such that the side wall faces the respective second end portions of the plurality of blades, the scroll casing being configured such that air is introduced through the air inlet and blown out to the outer peripheral side.

10 Claims, 7 Drawing Sheets

(56) References Cited

U.S. PATENT DOCUMENTS

| | | | | |
|---|---|---|---|---|
| 10,989,218 | B2 * | 4/2021 | Xu | F04D 29/282 |
| 2003/0053911 | A1 | 3/2003 | Sakai et al. | |
| 2016/0305435 | A1 | 10/2016 | Kamiya et al. | |
| 2017/0175764 | A1 * | 6/2017 | Usami | F04D 29/281 |
| 2019/0017515 | A1 * | 1/2019 | Sekito | F04D 29/4226 |
| 2019/0093665 | A1 * | 3/2019 | Ishii | F04D 17/16 |
| 2020/0032654 | A1 * | 1/2020 | Stonjek | F01D 5/141 |

FOREIGN PATENT DOCUMENTS

| | | | |
|---|---|---|---|
| CN | 206092502 | U | 4/2017 |
| EP | 1 887 227 | A1 | 2/2008 |
| EP | 4 137 702 | A1 | 2/2023 |
| JP | H11-166498 | A | 6/1999 |
| JP | 2000-145693 | A | 5/2000 |
| JP | 2000-240590 | A | 9/2000 |
| JP | 2002-070793 | A | 3/2002 |
| JP | 2003-090298 | A | 3/2003 |
| JP | 2011-226410 | A | 11/2011 |

OTHER PUBLICATIONS

International Search Report of the International Searching Authority mailed Nov. 17, 2020 in corresponding International Application No. PCT/JP2020/039891 (and English translation).
Office Action dated Jul. 5, 2021, issued in corresponding TW Patent Application No. 11020631330 (and English translation.
Office Action dated Dec. 10, 2021, issued in corresponding TW Patent Application No. 11021217970 (and English translation.
Office Action dated Jun. 27, 2022, issued in corresponding TW Patent Application No. 11120620110 (and English translation.
Extended European Search Report dated Nov. 6, 2023 issued in corresponding European Patent Application No. 20958724.5.

* cited by examiner

MULTI-BLADE CENTRIFUGAL AIR-SENDING DEVICE

CROSS REFERENCE TO RELATED APPLICATION

This application is a U.S. national stage application of PCT/JP2020/039891 filed on Oct. 23, 2020, the contents of which are incorporated herein by reference.

TECHNICAL FIELD

The present disclosure relates to a multi-blade centrifugal air-sending device including a scroll casing.

BACKGROUND

A multi-blade centrifugal air-sending device includes a fan and a scroll casing having a spiral shape and housing the fan. The fan is constituted by a back plate having a disk shape, a rim having an annular shape, and a plurality of blades provided between the back plate and the rim, and is configured to suck air from the side of the rim by rotating and cause the air to flow out to an air passage in the inside of the scroll casing via a space between the blades. The airflow is pressurized in the air passage in the inside of the scroll casing and blown out through an outlet. As a means for increasing the air volume in a multi-blade centrifugal air-sending device, there is a method of increasing the number of blades. When the number of blades is increased to increase the air volume, however, noise is increased due to the increase in the number of blades. Thus, there is a device (refer to, for example, Patent Literature 1) in which a forward blade (sirocco blade) is provided on the outer peripheral side of each blade and a rearward blade (turbo blade) is provided on the inner peripheral side of the blade to thereby increase the air volume without increasing the number of blades. In the multi-blade centrifugal air-sending device in Patent Literature 1, the side of a back plate of each blade is extended on the inner peripheral side with respect to the inner side position of a rim in the radial direction to be configured such that air is induced to the side of the back plate of the blade.

PATENT LITERATURE

Patent Literature 1: Japanese Unexamined Patent Application Publication No. 2000-240590

It is, however, impossible on the side of the rim between the blades to obtain the effect of pressurization by the turbo blade, since the turbo blade is not included in an end portion on the side of the rim while the sirocco blade and the turbo blade are included in an end portion on the side of the back plate in each blade of the multi-blade centrifugal air-sending device disclosed in Patent Literature 1.

SUMMARY

The present disclosure has been made to solve the aforementioned problem, and an object of the present disclosure is to provide a multi-blade centrifugal air-sending device capable of pressurizing air on the side of a rim between blades of a fan.

A multi-blade centrifugal air-sending device according to the present disclosure includes a fan including a back plate having a disk shape, a plurality of blades arranged at a peripheral portion of the back plate in a circumferential direction, and a rim having an annular shape and coupling the plurality of blades to each other, the plurality of blades being connected at respective first end portions on one side to the back plate, the rim being provided at respective second end portions of the plurality of blades on a side opposite to the one side where the respective first end portions are present; and a scroll casing having a spiral shape and including a side wall which faces the fan and where an air inlet is provided and a peripheral wall, the scroll casing housing the fan such that the side wall face the respective second end portions of the plurality of blades, the scroll casing being configured such that air is introduced through the air inlet and blown out to the outer peripheral side. Each of the blades includes a sirocco blade portion constituted by a forward blade, and a turbo blade portion constituted by a rearward blade and provided on the inner peripheral side with respect to the sirocco blade portion. The respective second end portions of the blades each extend along the side wall and include an end surface of the sirocco blade portion and an end surface of the turbo blade portion. Each of the blades extends from inner peripheral ends of the side wall toward the inner peripheral side such that a portion of the end surface of the turbo blade portion is positioned on the inner peripheral side with respect to the inner peripheral ends of the side wall while a remaining portion of the end surface of the turbo blade portion is covered by the side wall.

According to the present disclosure, the respective second end portions of the blades extending along the side wall each include the end surface of the sirocco blade portion and the end surface of the turbo blade portion, and each of the blades extends toward the inner side from the side wall such that a portion of the end surface of the turbo blade portion is exposed from the inner peripheral ends of the side wall while a remaining portion thereof is covered by the side wall. Therefore, a flow passage covered by the side wall and in which gaps between the blades are expanded toward the outer peripheral side by the turbo blade portion is formed on the side of the rim of the fan, and it is thus possible to provide a multi-blade centrifugal air-sending device capable of pressurizing air on the side of the rim of the fan.

BRIEF DESCRIPTION OF DRAWINGS

FIG. 6 is a schematic view of a configuration of a turbo blade portion of a blade of a multi-blade centrifugal air-sending device according to Embodiment 2 as viewed in a direction parallel to the rotational axis.

DETAILED DESCRIPTION

Hereinafter, a multi-blade centrifugal air-sending device 100 according to an embodiment will be described with reference to the drawings. In the following drawings including FIG. 1, relative dimensional relationships, shapes, and others of constituent members may differ from actual ones. Members having identical signs in the following drawings are identical or correspond to each other, which is common to the entire content of the description. For ease of understanding, terms indicating directions (for example, "upper", "lower", "forward", "rearward", and the other similar terms) are used, as appropriate. These terms are, however, merely thus used for convenience of description and are not intended to limit the arrangements and orientations of a device or components.

Embodiment 1

Figure 1:
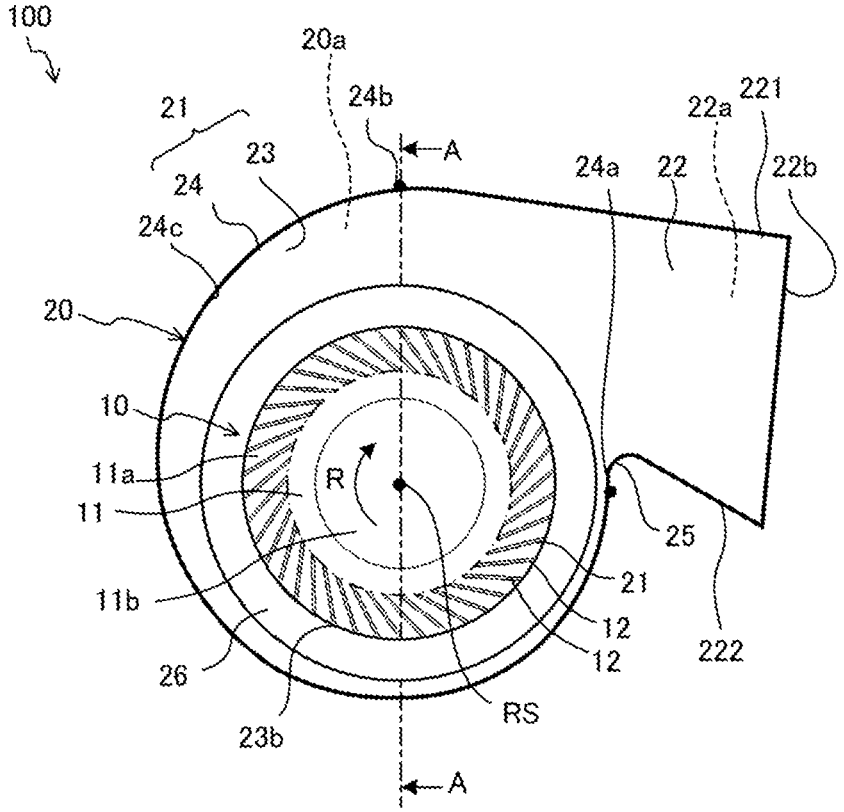
FIG. 1 is a schematic external view of a configuration of a multi-blade centrifugal air-sending device according to Embodiment 1 as viewed in a direction parallel to a rotational axis.
Figure 2:
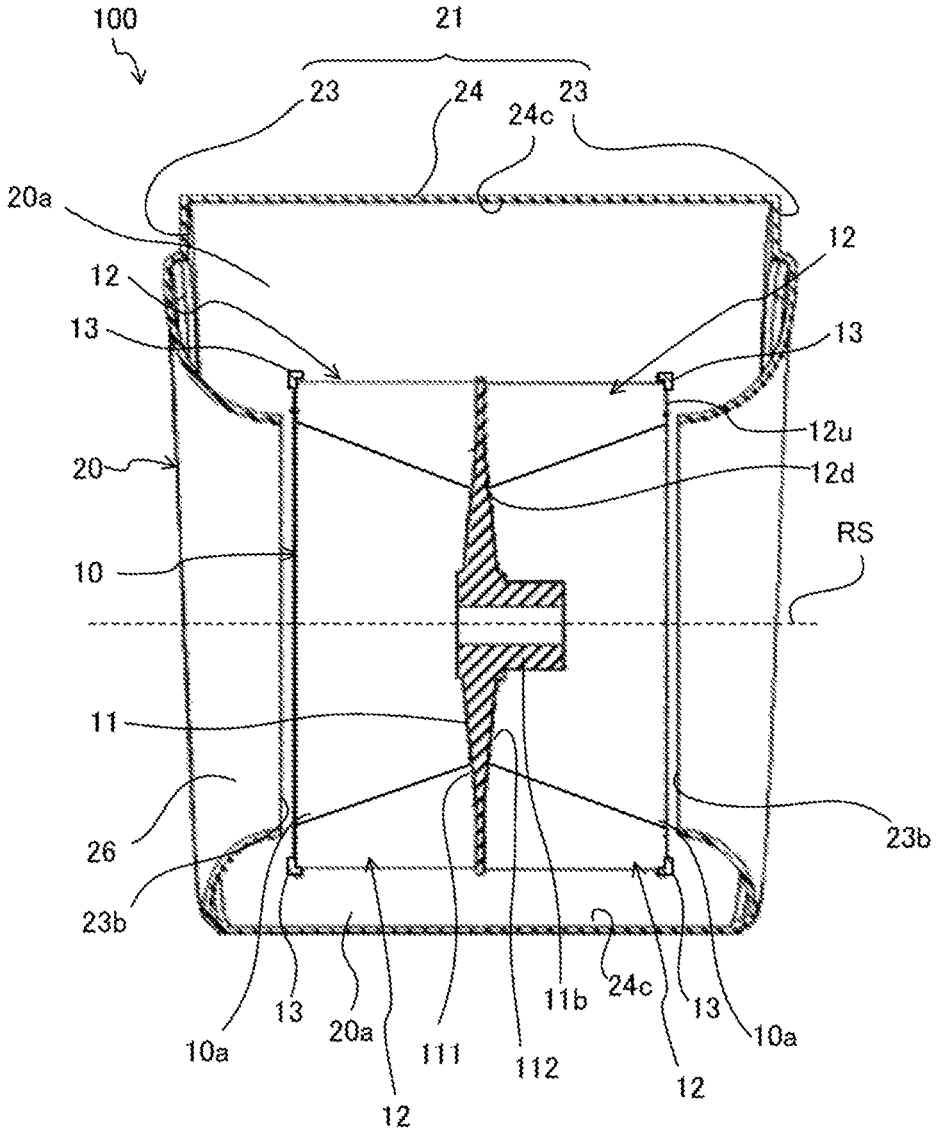
FIG. 2 is a sectional view in which a section of the multi-blade centrifugal air-sending device in FIG. 1 along line A-A is schematically illustrated.

FIG. 1 is a schematic external view of a configuration of the multi-blade centrifugal air-sending device 100 according to Embodiment 1 as viewed in a direction parallel to a rotational axis RS. FIG. 2 is a sectional view in which a section of the multi-blade centrifugal air-sending device 100 in FIG. 1 along line A-A is schematically illustrated. With reference to FIG. 1 and FIG. 2, a basic structure of the multi-blade centrifugal air-sending device 100 will be described.

As illustrated in FIG. 1, the multi-blade centrifugal air-sending device 100 is an air-sending device of a multi-blade centrifugal type and includes a fan 10 that generates an airflow, and a scroll casing 20 that houses the fan 10. The fan 10 includes a back plate 11 having a disk shape, a rim 13 (FIG. 2) having an annular shape and facing the back plate 11, and a plurality of blades 12 arranged at a peripheral portion of the back plate 11 in the circumferential direction of the back plate 11. The back plate 11 is provided with a shaft portion 11*b* to which a motor (not illustrated) is connected.

The scroll casing 20 includes a scroll portion 21 and a discharge portion 22 having a discharge port 22*b* for air, and rectifies the airflow blown out from the fan 10 in a centrifugal direction. The scroll casing 20 has a spiral shape, and an air passage 20*a* expanding gradually toward the discharge port 22*b* is formed in the inside of the scroll casing 20.

The scroll portion 21 forms the air passage 20*a* that converts a dynamic pressure of the airflow generated by the rotation of the fan 10 into a static pressure. The scroll portion 21 includes a side wall 23 covering the fan 10 in the axial direction of the rotational axis RS of the fan 10 and each having an air inlet 23*b* through which air is sucked; and a peripheral wall 24 surrounding the fan 10 from the outer side in the radial direction of the rotational axis RS. The scroll portion 21 also includes a tongue portion 25 positioned between the discharge portion 22 and a winding start portion 24*a* of the peripheral wall 24 and constituting a curved surface. The tongue portion 25 is configured to guide the airflow blown out from the fan 10 in the centrifugal direction in the vicinity of the winding start portion 24*a*, to be in a rotational direction R of the fan 10 to move toward the discharge port 22*b* via the scroll portion 21.

The radial direction of the rotational axis RS is a direction perpendicular to the axial direction of the rotational axis RS. An internal space of the scroll portion 21 constituted by the peripheral wall 24 and the side wall 23 serves as the above-described air passage 20*a*. In the air passage 20*a*, the airflow blown out from the fan 10 flows along the peripheral wall 24.

In the example illustrated in FIG. 2, the multi-blade centrifugal air-sending device 100 is a double-suction-type centrifugal air-sending device configured to suck air from both end sides in the axial direction of the imaginary rotational axis RS of the fan 10. The side wall 23 is disposed on both sides of the fan 10 in the axial direction of the rotational axis RS of the fan 10. Each side wall 23 of the scroll casing 20 has the air inlet 23*b* to enable air to circulate between the fan 10 and the outside of the scroll casing 20. As illustrated in FIG. 1, the air inlet 23*b* has a circular shape, and the fan 10 is disposed in the scroll casing 20 such that the center of the air inlet 23*b* and the center of the shaft portion 11*b* of the fan 10 substantially coincide with each other.

As illustrated in FIG. 2, the scroll casing 20 is a casing of a double suction type having, on both sides of the back plate 11 in the axial direction of the rotational axis RS of the fan 10, the side wall 23 having the air inlet 23*b*. The two side walls 23 are provided to face each other with the peripheral wall 24 interposed therebetween in the scroll casing 20.

As illustrated in FIG. 1, the air inlet 23*b* provided at each side wall 23 is formed by a bell mouth 26. That is, the bell mouth 26 forms the air inlet 23*b* in communication with a space formed by the back plate 11 and the plurality of blades 12 in the fan 10. In the following description, the space formed by the back plate 11 and the plurality of blades 12 may be referred to as a flow passage 11*a* of the fan 10.

As illustrated in FIG. 2, the bell mouth 26 rectifies the air sucked through the air inlet 23*b* of each side wall 23 and causes the air to flow into a central portion of the fan 10 through a fan air inlet 10*a*. The bell mouth 26 is provided to project from the side wall 23 toward the inside. More specifically, the bell mouth 26 is formed such that the opening diameter thereof decreases gradually from the side wall 23 of the scroll casing 20 toward the inside. With such a configuration, when the fan 10 rotates, the air in the vicinity of the air inlet 23*b* of each side wall 23 flows smoothly along the bell mouth 26 and flows into the fan 10 efficiently through the fan air inlet 10*a*.

As illustrated in FIG. 1, the peripheral wall 24 is constituted by a wall surface curved in the rotational direction R of the fan 10. The peripheral wall 24 is present, as illustrated in FIG. 2, between the two side walls 23 facing each other in the scroll casing 20 and is provided, as illustrated in FIG. 1, to connect portions of the outer peripheral edges of the two side walls 23 to each other. The peripheral wall 24 has a curved inner peripheral surface 24*c* and guides the airflow blown out to the air passage 20*a* in the scroll portion 21 from the fan 10, so as to flow along the inner peripheral surface 24*c* to the discharge port 22*b*.

The peripheral wall 24 has a configuration in which the wall surface curved as illustrated in FIG. 1 extends parallel to the axial direction of the rotational axis RS of the fan 10 as illustrated in FIG. 2. The peripheral wall 24 may have a form inclined with respect to the axial direction of the rotational axis RS of the fan 10, and is not limited to having the form disposed parallel to the axial direction of the rotational axis RS.

As illustrated in FIG. 1, the peripheral wall 24 covers the fan 10 from the outer side in the radial direction of the shaft portion 11*b* of the fan 10, and the inner peripheral surface 24*c* of the peripheral wall 24 faces end portions of the plurality of later-described blades 12 on the outer peripheral side. That is, the inner peripheral surface 24*c* of the peripheral wall 24 faces the air blowing-out side of the blades 12 of the fan 10. The peripheral wall 24 is provided to extend in the rotational direction R of the fan 10 from the winding start portion 24*a* positioned at the boundary between the peripheral wall 24 and the tongue portion 25 to a winding end portion 24*b* positioned at the boundary between the discharge portion 22 and the scroll portion 21 on the side away from the tongue portion 25. The winding start portion 24*a* is, of the peripheral wall 24 constituted by the curved wall surface, an end portion on the upstream side of the airflow generated by the rotation of the fan 10, and the winding end portion 24*b* is an end portion of the peripheral wall 24 on the downstream side of the airflow generated by the rotation of the fan 10. More specifically, the peripheral wall 24 has a spiral shape. The spiral shape is, for example, a logarithmic spiral, an Archimedes' spiral, or a spiral shape based on an involute curve or any other curve. With such a configuration, the airflow blown out from the fan 10 into the air passage 20*a* of the scroll casing 20 flows in the gap between the fan 10 and the peripheral wall 24 smoothly to the direction of the discharge portion 22. Therefore, the static pressure of air increases in the rotational direction R of the fan 10 from the tongue portion 25 toward the discharge portion 22 in the scroll casing 20.

The discharge portion 22 forms the discharge port 22*b* through which the airflow that has been generated by the rotation of the fan 10 and passed through the air passage 20*a* of the scroll portion 21 is discharged. The discharge portion 22 is constituted by a hollow pipe whose section orthogonal to the flow direction of discharged air has a rectangular shape. The discharge portion 22 is constituted by, for example, plate-shaped four side surfaces. Specifically, the discharge portion 22 includes an extended plate 221 smoothly connected to the winding end portion 24*b* of the peripheral wall 24, and a diffuser plate 222 extending from the tongue portion 25 to face the extended plate 221. The discharge portion 22 also includes a first side wall portion and a second side wall portion (not illustrated) each extended from a corresponding one of the two side walls 23 to connect both ends of the extended plate 221 and the diffuser plate 222 in the axial direction of the rotational axis RS to each other. The sectional shape of the discharge portion 22 is not limited to a rectangular shape. The discharge portion 22 forms a discharge-side air passage 22*a* that guides the airflow discharged from the fan 10 and flowing through the gap between the peripheral wall 24 and the fan 10, to be discharged to the outside of the scroll casing 20.

The tongue portion 25 is formed between the diffuser plate 222 of the discharge portion 22 and the winding start portion 24*a* of the peripheral wall 24 in the scroll casing 20. The tongue portion 25 is formed to have a predetermined radius of curvature, and the peripheral wall 24 is smoothly connected to the diffuser plate 222 with the tongue portion 25 interposed therebetween. The tongue portion 25 suppresses the inflow of air from the winding end portion to the winding start portion of the spiral air passage 20*a* formed in the inside of the scroll casing 20. In other words, the tongue portion 25 has a role of separating the airflow flowing from an upstream portion of the air passage 20*a* in the rotational direction R of the fan 10 and the airflow flowing from a downstream portion of the air passage 20*a* toward the discharge port 22*b* in a discharge direction from each other. The static pressure of the airflow flowing into the discharge-side air passage 22*a* of the discharge portion 22 increases while the airflow passes through the scroll casing 20, to be higher than in the scroll casing 20. The tongue portion 25 is thus configured to have a function of partitioning such different pressures.

Figure 3:
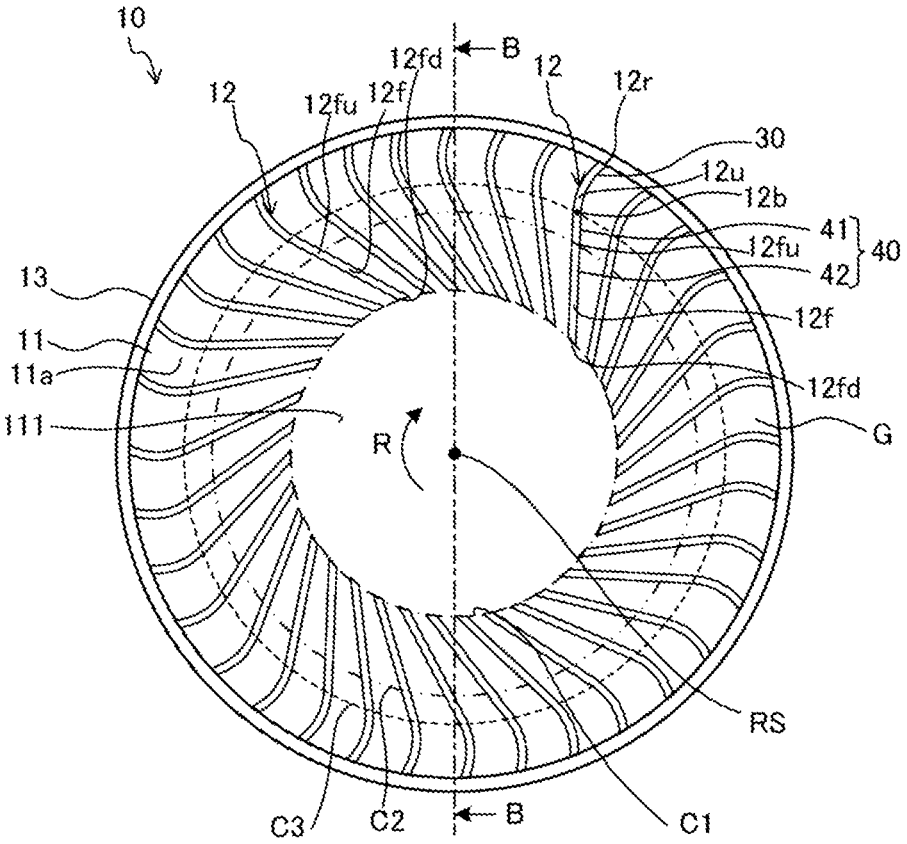
FIG. 3 is a schematic view of a configuration of a fan of the multi-blade centrifugal air-sending device in FIG. 1 as viewed in a direction parallel to the rotational axis.
Figure 4:
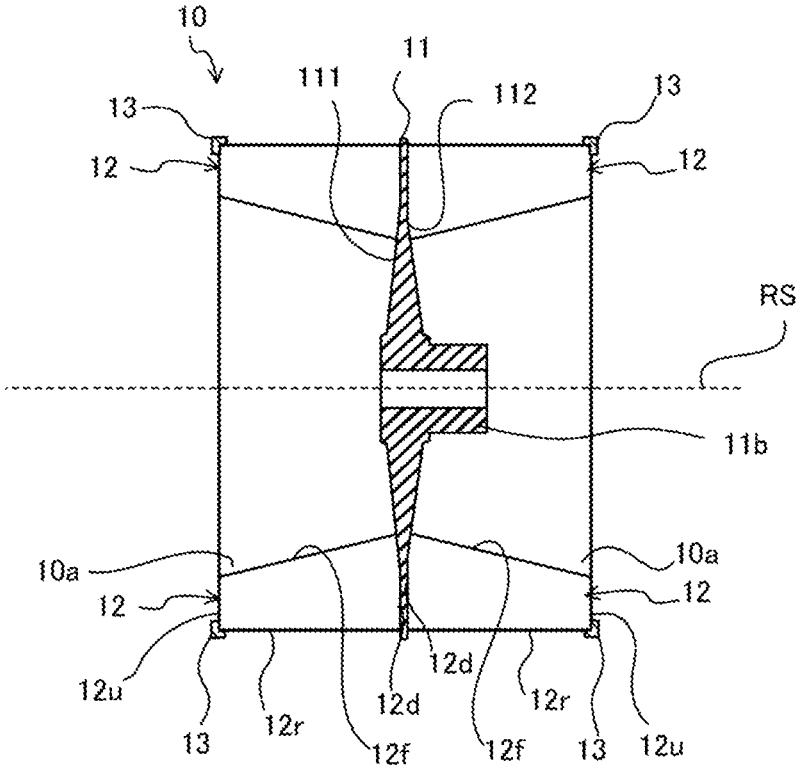
FIG. 4 is a sectional view in which a section of the fan in FIG. 3 along line B-B is schematically illustrated.

FIG. 3 is a schematic view of a configuration of the fan 10 of the multi-blade centrifugal air-sending device 100 in FIG. 1 as viewed in a direction parallel to the rotational axis RS. FIG. 4 is a sectional view in which a section of the fan 10 in FIG. 3 along line B-B is schematically illustrated. As illustrated in FIG. 3, the fan 10 is a centrifugal fan. The fan 10 is constituted by, for example, a resin material, and, for example, the back plate 11, the plurality of blades 12, and the rim 13 can be integrally molded by injection molding. The fan 10 is configured to be driven to rotate by, for example, a motor (not illustrated) and to forcibly send air in the centrifugal direction, that is, radially outward by a centrifugal force generated by rotating and suck air through the fan air inlet 10*a* (refer to FIG. 4) provided on the side of the rim 13. The fan 10 is rotated by, for example, a motor in the rotational direction R.

As illustrated in FIG. 4, the back plate 11 may be formed such that the wall thickness thereof increases toward the center in the radial direction with the rotational axis RS as the center, or may be formed to have a thickness that is constant in the radial direction with the rotational axis RS as the center. The back plate 11 may have a shape other than a disk shape as long as the back plate 11 has a plate shape and may have, for example, a polygonal shape or any other shape. A motor (not illustrated) is connected to the shaft portion 11*b* provided at a center portion of the back plate 11, and the back plate 11 is driven to rotate by the motor via the shaft portion 11*b*.

As illustrated in FIG. 3, the plurality of blades 12 are disposed in the circumferential direction of a plate surface 111 of the back plate 11 with the rotational axis RS as the center such that a predetermined interval is formed between mutually adjacent blades 12. The plurality of blades 12 disposed at the back plate 11 form the cylindrical shape of the fan 10. A gap G formed between mutually adjacent blades 12 constitutes the flow passage 11*a* of the fan 10.

Each of the plurality of radially provided blades 12 includes a sirocco blade portion 30 constituted by a forward blade, and a turbo blade portion 40 constituted by a rearward blade. The turbo blade portion 40 is connected to the sirocco blade portion 30 in the radial direction, and each blade 12 has a shape curved in the radial direction. The turbo blade portion 40 is provided on the inner peripheral side with respect to the sirocco blade portion 30 to be continuous with the sirocco blade portion 30. The sirocco blade portion 30 and the turbo blade portion 40 are smoothly connected to each other at a blade boundary 12*b* between the sirocco blade portion 30 and the turbo blade portion 40.

As illustrated in FIG. 3 and FIG. 4, in the rotation of the back plate 11 about the rotational axis RS, an end surface of each blade 12 on the inner peripheral side is a blade leading edge 12*f*, and an end surface of each blade 12 on the outer peripheral side is a blade trailing edge 12*r*. In the example illustrated in FIG. 3, the turbo blade portion 40 is linearly formed from the blade boundary 12*b* to the blade leading edge 12*f*. As illustrated in FIG. 4, the blade leading edge 12*f* is inclined with respect to the axial direction of the rotational axis RS such that the blade leading edge 12*f* gradually approaches the rotational axis RS from the side of the rim 13 toward the side of the back plate 11 in the axial direction of the rotational axis RS. The blade trailing edge 12*r* and the blade boundary 12*b* are each substantially parallel to the rotational axis RS. The detailed configuration of each of the blades 12 will be described later.

As illustrated in FIG. 4, each of the plurality of blades 12 is provided between the back plate 11 and the rim 13 in the axial direction of the rotational axis RS. In the axial direction of the rotational axis RS, one end of each of the blades 12 is connected to the back plate 11, and the other end of each of the blades 12 extends to the position of the rim 13.

In the following description, the one end of each blade 12 connected to the back plate 11 and the other end of the blade 12 on the side of the rim 13 in the axial direction of the rotational axis RS may be referred to as an end portion 12*d* on the side of the back plate 11 and an end portion 12*u* on the side of the rim 13, respectively. In addition, in the following description, a portion of the blade leading edge 12*f* of each of the blades 12 connected to the end portion 12*d* on the side of the back plate 11 is referred to as a main-plate-side inner peripheral end 12*fd*, and a portion of the blade leading edge 12*f* of each of the blades 12 connected to the end portion 12*u* on the side of the rim 13 is referred to as a side-plate-side inner peripheral end 12*fu*.

In FIG. 3, a first imaginary circle C1 passing through the main-plate-side inner peripheral ends 12*fd* of the blade leading edges 12*f* of the plurality of blades 12 is indicated by a dash-dotted line, and a third imaginary circle C3 passing through the blade boundaries 12*b* of the plurality of blades 12 is indicated by a dashed line. In addition, a second imaginary circle C2 formed by projecting the inner peripheral ends, that is, the air inlets 23*b* of the side wall 23 of the scroll casing 20 illustrated in FIG. 1 in the axial direction is indicated by a dashed double-dotted line in FIG. 3. The first imaginary circle C1, the second imaginary circle C2, and the third imaginary circle C3 are each a circle centered at the imaginary rotational axis RS of the back plate 11.

In a state in which the fan 10 is housed in the scroll casing 20 as illustrated in FIG. 2, the end portion 12*u* of each blade 12 on the side of the rim 13 extends along the side wall 23 to be substantially parallel to the side wall 23, and a portion of each blade 12 extends toward the inner side further than the inner peripheral ends of the side wall 23. In the example illustrated in FIG. 2, the end portion 12*u* of each blade 12 on the side of the rim 13 and the end portion 12*d* thereof on the side of the back plate 11 are substantially parallel to each other and extend linearly in a direction perpendicular to the axial direction of the rotational axis RS.

The rim 13 maintains the positional relationship of the tips of the blades 12 and reinforces the plurality of blades 12. The fan air inlet 10*a* for causing a gas to flow into the flow passage 11*a* of the fan 10 is provided on the side of the rim 13 in the fan 10.

In the example illustrated in FIG. 4, the rim 13 is provided on the side of the blade trailing edges 12*r* at the end portions 12*u* of the plurality of blades 12. In addition, in the example illustrated in FIG. 4, the rim 13 and the plurality of blades 12 are provided on both sides of the back plate 11 in the axial direction of the rotational axis RS. The rim 13 provided on the side of the plate surface 111 of the back plate 11 on one side couples the plurality of blades 12 disposed on the side of the plate surface 111 of the back plate 11 on the one side to each other. The rim 13 provided on the side of the plate surface 112 of the back plate 11 on the other side couples the plurality of blades 12 disposed on the side of the plate surface 112 of the back plate 11 on the other side to each other.

As illustrated in FIG. 2, the fan 10 is housed in the scroll casing 20 such that the side wall 23 of the scroll casing 20 faces the end portions 12*u* of the plurality of blades 12 of the fan 10. Specifically, the fan 10 is set in the scroll casing 20 such that the center of the fan air inlet 10*a* provided on the side of the rim 13 in the fan 10 and the center of the air inlet 23*b* provided at each side wall 23 of the scroll casing 20 coincide with each other. The fan 10 is supported about an axis by the scroll casing 20 to be rotatable.

Since a portion of each blade 12 extends on the inner peripheral side further than the inner peripheral ends of the side wall 23 as described above, the air sucked through the fan air inlet 10*a* is easily taken into the flow passage 11*a* of the fan 10 due to the extended blade portion. Since the blade leading edge 12*f* is inclined as described with reference to FIG. 4, it is possible to reduce resistance on the side of the rim 13 at the blade portion extending further on the inner peripheral side than the inner peripheral ends of the side wall 23, and possible to suppress, for example, obstruction of air suction into the back plate 11 and an increase of noise.

Since the turbo blade portion 40 is provided on the inner peripheral side with respect to the sirocco blade portion 30 as illustrated in FIG. 3, the gap G between mutually adjacent blades 12 is inclined from the side of the blade leading edge 12*f* toward the blade boundary 12*b* in a direction opposite to the rotational direction R. Therefore, the air caused by the rotation of the fan 10 to flow into a central portion through the fan air inlet 10*a* can be highly efficiently taken into and sent to the flow passage 11*a* of the fan 10. It is thus possible to obtain an effect of increasing the air volume.

Figure 5:
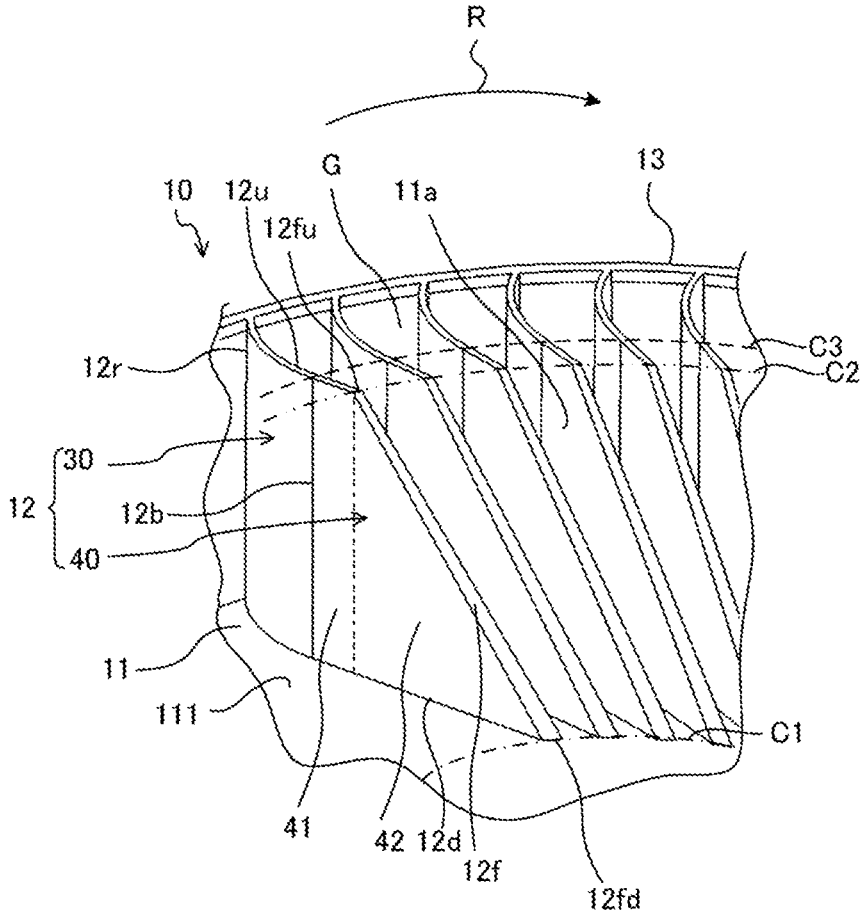
FIG. 5 is a partial perspective view in which a portion of an outer peripheral portion of the fan in FIG. 3 is enlarged.

FIG. 5 is a partial perspective view in which a portion of an outer peripheral portion of the fan 10 in FIG. 3 is enlarged. In FIG. 5, a portion of the fan 10 on the side of the plate surface 111 of the back plate 11 on one side is illustrated. Hereinafter, with the side of the rim 13 and the side of the back plate 11 in the axial direction of the rotational axis RS being defined as the upper side and the lower side, respectively, a detailed configuration of the blades 12 will be described with reference to FIG. 3 and FIG. 5.

As illustrated in FIG. 5, in the blades 12, the blade boundaries 12*b* indicated by the third imaginary circle C3 are positioned on the outer peripheral side with respect to the side-plate-side inner peripheral ends 12*fu* of the blade leading edges 12*f*. The end portion 12*u* of each blade 12 on the upper side includes an upper end portion constituting the upper surface of the sirocco blade portion 30 and an upper end portion constituting the upper surface of the turbo blade portion 40. The end portion 12*d* of each blade 12 on the lower side includes a lower end portion constituting the lower surface of the sirocco blade portion 30 and a lower end portion constituting the lower surface of the turbo blade portion 40. The turbo blade portion 40 includes a first turbo blade portion 41 connected to the sirocco blade portion 30, and a second turbo blade portion 42 on the inner peripheral side with respect to the first turbo blade portion 41. The first turbo blade portion 41 includes the entirety of the upper end portion of the turbo blade portion 40 and has a quadrangular shape when the blade 12 is viewed from the rear side in the rotational direction R. The second turbo blade portion 42 includes the entirety of the blade leading edge 12*f* of the blade 12 and has a triangular shape when the blade 12 is viewed from the rear side in the rotational direction R.

In a state in which the fan 10 is housed in the scroll casing 20 as illustrated in FIG. 1, the blade boundaries 12*b* of the blades 12 indicated by the third imaginary circle C3 in FIG. 5 are positioned on the outer peripheral side with respect to the inner peripheral ends of the side wall 23 indicated by the second imaginary circle C2.

In the example illustrated in FIG. 5, the side-plate-side inner peripheral ends 12*fu* of the blade leading edges 12*f* are positioned at the inner peripheral ends of the side wall 23

(refer to FIG. 1) indicated by the second imaginary circle C2 in the radial direction. That is, in the example illustrated in FIG. 5, the entirety of the upper surface of the first turbo blade portion 41 is covered by the side wall 23, and the entirety of the second turbo blade portion 42 is exposed on the inner side from the side wall 23. In the radial direction, the positions of the side-plate-side inner peripheral ends 12*fu* of the blade leading edges 12*f* do not need to coincide with the positions of the inner peripheral ends of the side wall 23. As long as at least a portion of the turbo blade portion 40 is positioned on the inner peripheral side with respect to the inner peripheral ends of the side wall 23 in the radial direction, air can be taken into the flow passage 11*a* of the fan 10 by an extended portion of each blade 12. Preferably, in order to increase the suction air volume also on the side of the rim 13 of the blades 12, the side-plate-side inner peripheral ends 12*fu* of the blade leading edges 12*f* are positioned on the inner peripheral side with respect to the inner peripheral ends of the side wall 23 (FIG. 1) indicated by the second imaginary circle C2 in the radial direction.

Figure 6:
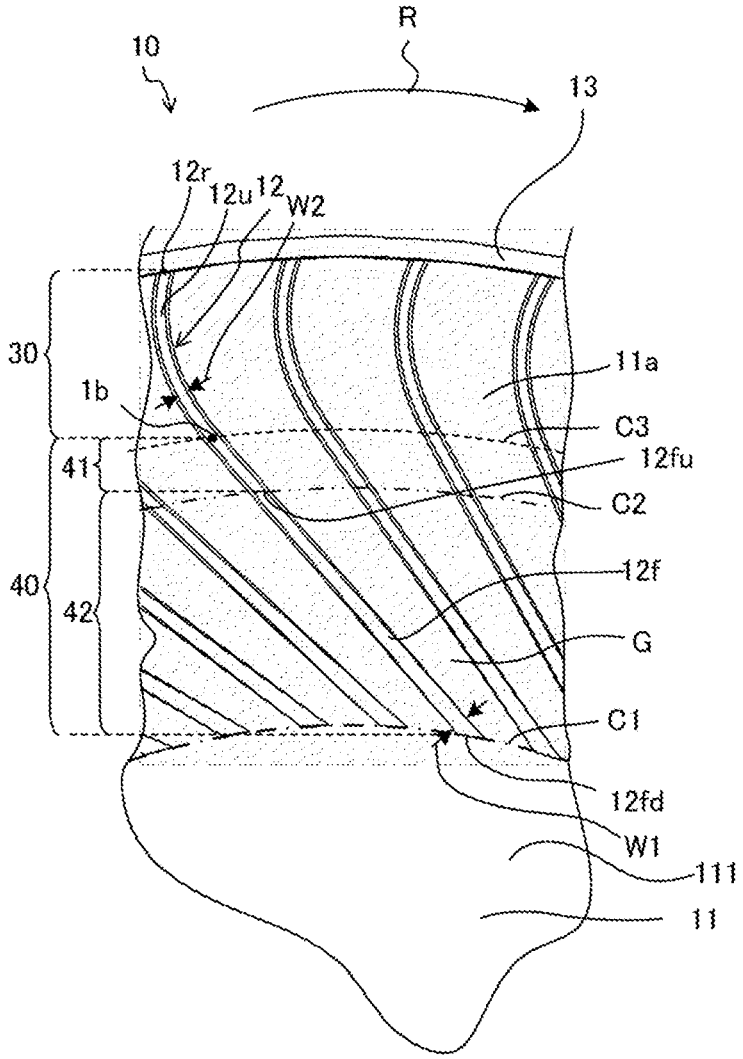
FIG. 6 is a view of a configuration of the portion of the outer peripheral portion of the fan illustrated in FIG. 5 as viewed in a direction parallel to the rotational axis.

FIG. 6 is a view of a configuration of a portion of the outer peripheral portion of the fan 10 illustrated in FIG. 5 as viewed in a direction parallel to the rotational axis RS. As illustrated in FIG. 6, in each blade 12 set on the back plate 11, the main-plate-side inner peripheral end 12*fd* and the side-plate-side inner peripheral end 12*fu* of the blade leading edge 12*f* are substantially parallel to each other.

In the example illustrated in FIG. 6, each of the blades 12 has a wall thickness that is substantially uniform in the radial direction. As illustrated in FIG. 6, a wall thickness W2 of each blade 12 at the end portion 12*u* on the side of the rim 13 is thinner than a wall thickness W1 of the blade 12 at the end portion 12*d* (FIG. 5) on the side of the back plate 11, and the wall thickness of the blade 12 is configured to become thinner gradually from the end portion 12*d* toward the end portion 12*u*. Therefore, the gap G formed between mutually adjacent blades 12 expands gradually from the blade leading edge 12*f* toward the blade trailing edge 12*r* in the radial direction and expands gradually from the side of the back plate 11 toward the side of the rim 13 in the axial direction.

With reference to FIG. 1 to FIG. 6, operation of the multi-blade centrifugal air-sending device 100 will be described. As illustrated in FIG. 1, when the fan 10 is driven to rotate about the rotational axis RS by a motor (not illustrated), air outside the multi-blade centrifugal air-sending device 100 flows into a central portion of the fan 10 in the axial direction through the air inlets 23*b* of the scroll casing 20 and the fan air inlet 10*a*. The air that has flowed into the central portion of the fan 10 is taken into the flow passage 11*a* of the fan 10 from the blade leading edges 12*f* due to the rotation of the fan 10 and flows radially outward in the flow passage 11*a*.

As described with reference to FIG. 5 and FIG. 6, the gap G formed between mutually adjacent blades 12 expands gradually from the blade leading edge 12*f* toward the blade trailing edge 12*r* and expands gradually from the side of the back plate 11 toward the side of the rim 13. Therefore, it is possible to increase the suction air volume on the side of the rim 13 at the second turbo blade portion 42, send the air that has been taken into the flow passage 11*a* from the side of the back plate 11 at the blade leading edge 12*f*, to the side of the rim 13, that is, to the upper side, and increase the air volume on the side of the rim 13 even in a configuration in which the blade leading edge 12*f* is inclined. The airflow that flows toward the blade boundary 12*b* on the upper side of the flow passage 11*a* in which the air volume is increased is highly efficiently pressurized by the first turbo blade portion 41 extending from the back plate 11 to the rim 13 and covered by the side wall 23 (FIG. 1).

The pressurized airflow that has flowed along the first turbo blade portion 41 in the flow passage 11*a* reaches the blade boundary 12*b* and then flows toward the blade trailing edge 12*r* while changing the traveling direction thereof along the sirocco blade portion 30. Thereafter, the airflow that has reached the blade trailing edge 12*r* is sent from the flow passage 11*a* of the fan 10 to the air passage 20*a* of the scroll casing 20. The airflow that has been sent from the fan 10 to the air passage 20*a* is further pressurized when passing through the spiral air passage 20*a* expanding toward the discharge port 22*b*, and is blown out to the outer peripheral side through the discharge port 22*b*.

In Embodiment 1, the multi-blade centrifugal air-sending device 100 that is a double-suction-type centrifugal air-sending device has been described. The multi-blade centrifugal air-sending device 100, however, may be a single-suction-type centrifugal air-sending device. The number of the blades 12 is not limited to that in the drawings.

As described above, in Embodiment 1, the multi-blade centrifugal air-sending device 100 includes the fan 10 and the scroll casing 20 having a spiral shape. The fan 10 includes the back plate 11 having a disk shape, the plurality of blades 12 arranged in the circumferential direction at the peripheral portion of the back plate 11, and the rim 13 having an annular shape and coupling the plurality of blades 12 to each other. Respective first end portions (end portions 12*d*) of the plurality of blades 12 on one side are connected to the back plate 11, and the rim 13 is provided at respective second end portions (end portions 12*u*) of the plurality of blades 12 on a side opposite to the one side where the respective first end portions are present. The scroll casing 20 includes the side wall 23 which faces the fan 10 where the air inlet 23*b* is provided and the peripheral wall 24. The scroll casing 20 houses the fan 10 such that the side wall 23 faces the second end portions (end portions 12*u*) of the plurality of blades 12, and is configured such that air is introduced through the air inlets 23*b* and blown out to the outer peripheral side. Each blade 12 includes the sirocco blade portion 30 constituted by the forward blade, and the turbo blade portion 40 constituted by the rearward blade and provided on the inner peripheral side with respect to the sirocco blade portion 30. The second end portion (end portion 12*u*) of each blade 12 extends along the side wall 23 and includes an end surface of the sirocco blade portion 30 and an end surface of the turbo blade portion 40. Each blade 12 extends from the inner peripheral ends of the side wall 23 toward the inner peripheral side such that a portion of the end surface of the turbo blade portion 40 is positioned on the inner peripheral side with respect to the inner peripheral ends of the side wall 23 while a remaining portion of the end surface of the turbo blade portion 40 is covered by the side wall 23.

Consequently, the flow passage 11*a* covered by the side wall 23 and in which the gap G between the blades 12 is widened gradually toward the outer peripheral side by the turbo blade portion 40 is formed on the side of the rim 13 in the axial direction of the fan 10. It is thus possible to provide the multi-blade centrifugal air-sending device 100 capable of pressurizing air on the side of the rim 13 in the flow passage 11*a* of the fan 10.

The wall thicknesses W1 and W2 of each blade 12 are configured to decrease gradually from the first end portion (end portion 12*d*) on the side of the back plate 11 toward the second end portion (end portion 12*u*) on the side of the rim 13. Consequently, the gap G formed between the mutually adjacent blades 12 expands gradually from the end portion 12*d* on the side of the back plate 11 toward the end portion 12*u* on the side of the rim 13 in the axial direction, and it is thus possible to increase the suction air volume on the side of the rim 13.

The turbo blade portion 40 of each blade 12 is formed to extend linearly from the side of the sirocco blade portion 30 toward the inner peripheral side. Consequently, it is possible to simplify the shape of each blade 12 and possible to facilitate manufacture of the fan 10 and reduce costs thereof, compared with a configuration in which the turbo blade portion 40 is curved in each blade 12.

Embodiment 2

Figure 7:
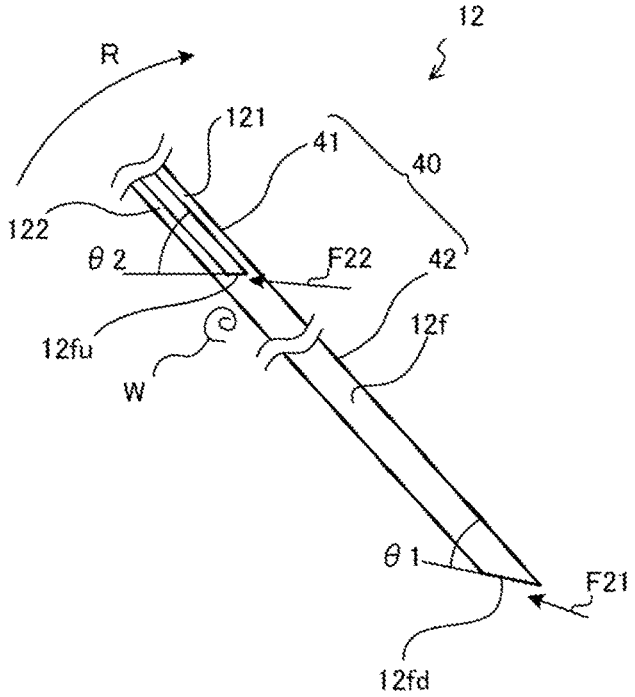

FIG. 7 is a schematic view of a configuration of the turbo blade portion 40 of each blade 12 of the multi-blade centrifugal air-sending device 100 according to Embodiment 2 as viewed in a direction parallel to the rotational axis RS. In Embodiment 2, the positional relationship between the main-plate-side inner peripheral end 12*fd* and the side-plate-side inner peripheral end 12*fu* of the blade leading edge 12*f* differs from that in Embodiment 1.

In FIG. 7, the arrow F21 indicates the direction of an airflow that passes the vicinity of the main-plate-side inner peripheral end 12*fd* of the blade leading edge 12*f* during rotation of the fan 10, and the arrow F22 indicates the direction of an airflow that passes the vicinity of the side-plate-side inner peripheral end 12*fu* of the blade leading edge 12*f* during rotation of the fan 10. While the fan 10 rotates, as illustrated in FIG. 7, an airflow in which the percentage of a circumferential-direction component increases toward the outer peripheral side of the blade leading edge 12*f* is generated in the vicinity of the blade leading edge 12*f*. In other words, at the blade leading edge 12*f*, the percentage of the circumferential-direction component in the airflow that passes the side-plate-side inner peripheral end 12*fu* is larger than the percentage of the circumferential-direction component in the airflow that passes the main-plate-side inner peripheral end 12*fd*.

Thus, in Embodiment 2, the blade leading edge 12*f* is configured such that an angle θ2 formed by the side-plate-side inner peripheral end 12*fu* of the blade leading edge 12*f* and a pressure surface 121 is larger than an angle θ1 formed by the main-plate-side inner peripheral end 12*fd* of the blade leading edge 12*f* and the pressure surface 121. A corner where the blade leading edge 12*f* and the pressure surface 121 meet each other may be chamfered into an arc shape. In Embodiment 2, the angle θ1 and the angle θ2 satisfy the following relationship.

[Math. 1]

$$0° < \theta 1 < \theta 2 < 90° \quad \text{(Formula 1)}$$

As described above, in Embodiment 2, the blade leading edge 12*f* of each blade 12 is formed such that the angle θ2 formed by the side-plate-side inner peripheral end 12*fu* of the blade leading edge 12*f* and the pressure surface 121 is larger than the angle θ1 formed by the main-plate-side inner peripheral end 12*fd* of the blade leading edge 12*f* and the pressure surface 121.

Consequently, it is possible to suppress generation of a separation vortex W at a suction surface 122 on the side of the side-plate-side inner peripheral end 12*fu* of the blade leading edge 12*f*, and possible to suppress a decrease of the air volume due to separation of the airflow from the suction surface 122 and suppress an increase of noise due to generation of the separation vortex W.

Embodiment 3

Figure 8:
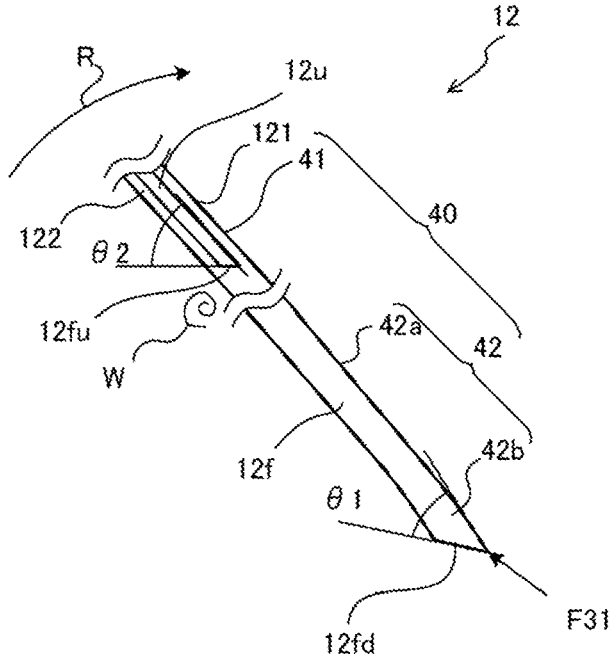
FIG. 8 is a schematic view of a configuration of a turbo blade portion of a blade of a multi-blade centrifugal air-sending device according to Embodiment 3 as viewed in a direction parallel to the rotational axis.

FIG. 8 is a schematic view of a configuration of the turbo blade portion 40 of each blade 12 of the multi-blade centrifugal air-sending device 100 according to Embodiment 3 as viewed in a direction parallel to the rotational axis RS. As with Embodiment 2, the configuration in Embodiment 3 also satisfies the relationship in Formula 1. In Embodiment 3, the shape of the turbo blade portion 40 in the radial direction differs from those in Embodiment 1 and Embodiment 2. In FIG. 8, the arrow F31 indicates the direction of an airflow that passes the vicinity of the main-plate-side inner peripheral end 12*fd* of the blade leading edge 12*f* during rotation of the fan 10.

As illustrated in FIG. 8, the turbo blade portion 40 is constituted by a linear portion extending linearly from the blade boundary 12*b* (FIG. 3) with respect to the sirocco blade portion 30 toward the inner peripheral side, and an inner peripheral end portion 42*b* curved and connected to the linear portion in the radial direction. The inner peripheral end portion 42*b* of the turbo blade portion 40 includes at least a portion of the blade portion extending toward the inner side further than the inner peripheral end of the side wall 23 in FIG. 1. In the example illustrated in FIG. 8, the linear portion of the turbo blade portion 40 is constituted by the first turbo blade portion 41 and a portion 42*a* of the second turbo blade portion 42 on the side of the first turbo blade portion 41. The inner peripheral end portion 42*b* of the turbo blade portion 40 is constituted by a remaining portion of the second turbo blade portion 42 excluding the portion 42*a*.

The inner peripheral end portion 42*b* of the turbo blade portion 40 is curved with respect to the linear portion in a direction opposite to the rotational direction R of the fan 10, and has a shape protruding in the rotational direction R of the fan 10.

Generally, the direction of the airflow flowing into the fan 10 of the multi-blade centrifugal air-sending device 100 varies depending on an environment (including atmospheric pressure conditions, and other conditions) in which the multi-blade centrifugal air-sending device 100 is used and on the capacity range to which the multi-blade centrifugal air-sending device 100 belongs. For example, under a high-pressure environment, the airflow does not easily flows in the radial direction compared with under a low-pressure environment, and the percentage of the circumferential-direction component in the airflow increases compared with under a low-pressure environment. Meanwhile, under a low-pressure environment, the airflow easily flows in the radial direction compared with under a high-pressure environment, and the percentage of a radial-direction component in the airflow increases compared with under a high-pressure environment.

Thus, in Embodiment 3, the inner peripheral end portion 42*b* of the turbo blade portion 40 has a curved shape to thereby configure such that an inclination of the blade leading edge 12*f* in accordance with a usage environment can be easily formed while maintaining the relationship in Formula 1 by adjusting the degree of the curve.

As described above, in the multi-blade centrifugal air-sending device 100 according to Embodiment 3, the turbo blade portion 40 of each blade 12 is constituted by the linear portion extending linearly from the side of the sirocco blade portion 30 toward the inner peripheral side, and the inner peripheral end portion 42*b* curved and connected to the linear portion in the radial direction.

Consequently, it becomes easy to provide the multi-blade centrifugal air-sending device 100 in which the inclination of the main-plate-side inner peripheral end 12*fd* varies while the relationship in Formula 1 is satisfied. Therefore, it is possible to provide the multi-blade centrifugal air-sending device 100 capable of, in response to an airflow whose direction changes at the main-plate-side inner peripheral end 12*fd* of the blade leading edge 12*f* depending on an environment in which the multi-blade centrifugal air-sending device 100 is used, pressurizing the airflow highly efficiently while suppressing separation of the airflow from the suction surface 122.

Note that the embodiments can be combined together, and modifications and omissions can be performed, as appropriate, in each embodiment. For example, the rim 13 of the fan 10 may be configured to extend from the blade trailing edges 12*r* to the positions of the inner peripheral ends of the side wall 23 indicated by the second imaginary circle C2 to cover the entirety of the end portion 12*u* of each blade 12.

The invention claimed is:

1. A multi-blade centrifugal air-sending device comprising:

a fan including a back plate having a disk shape, a plurality of blades arranged at a peripheral portion of the back plate in a circumferential direction, and a rim having an annular shape and coupling the plurality of blades to each other, the plurality of blades being connected at respective first end portions on one side to the back plate, the rim being provided at respective second end portions of the plurality of blades on a side opposite to the one side where the respective first end portions are present; and a scroll casing having a spiral shape and including a side wall which faces the fan and where an air inlet is provided and a peripheral wall, the scroll casing housing the fan such that the side wall faces the respective second end portions of the plurality of blades, the scroll casing being configured such that air is introduced through the air inlet and blown out to an outer peripheral side, wherein each of the blades includes a sirocco blade portion constituted by a forward blade, and a turbo blade portion constituted by a rearward blade and provided on an inner peripheral side with respect to the sirocco blade portion, wherein, in a side view, the respective second end portions of the blades each extend linearly along the side wall in a direction perpendicular to a rotational axis of the fan, and include an end surface of the sirocco blade portion and an end surface of the turbo blade portion, and wherein each of the blades beyond inner peripheral ends of the side wall toward the inner peripheral side such that a portion of the end surface of the turbo blade portion is positioned on the inner peripheral side with respect to the inner peripheral ends of the side wall while a remaining portion of the end surface of the turbo blade portion is covered by the side wall.

2. The multi-blade centrifugal air-sending device of claim 1, wherein a wall thickness of each of the blades decreases gradually from the respective first end portions on a side of the back plate toward the respective second end portions on a side of the rim.

3. The multi-blade centrifugal air-sending device of claim 1, wherein a blade leading edge of each of the blades is formed such that an angle θ2 formed by a side-plate-side inner peripheral end of the blade leading edge and a pressure surface is larger than an angle θ1 formed by a main-plate-side inner peripheral end of the blade leading edge and the pressure surface.

4. The multi-blade centrifugal air-sending device of claim 1, wherein the turbo blade portion of each of the blades is formed to extend linearly from a side of the sirocco blade portion toward the inner peripheral side.

5. The multi-blade centrifugal air-sending device of claim 3, wherein the turbo blade portion of each of the blades is constituted by a linear portion extending linearly from a side of the sirocco blade portion toward the inner peripheral side, and a curved inner peripheral end portion connected to the linear portion in a radial direction.

6. The multi-blade centrifugal air-sending device of or claim 2, wherein a blade leading edge of each of the blades is formed such that an angle θ2 formed by a side-plate-side inner peripheral end of the blade leading edge and a pressure surface is larger than an angle θ1 formed by a main-plate-side inner peripheral end of the blade leading edge and the pressure surface.

7. The multi-blade centrifugal air-sending device of claim 2, wherein the turbo blade portion of each of the blades is formed to extend linearly from a side of the sirocco blade portion toward the inner peripheral side.

8. The multi-blade centrifugal air-sending device of claim 3, wherein the turbo blade portion of each of the blades is formed to extend linearly from a side of the sirocco blade portion toward the inner peripheral side.

9. The multi-blade centrifugal air-sending device of claim 6, wherein the turbo blade portion of each of the blades is formed to extend linearly from a side of the sirocco blade portion toward the inner peripheral side.

10. The multi-blade centrifugal air-sending device of claim 6, wherein the turbo blade portion of each of the blades is constituted by a linear portion extending linearly from a side of the sirocco blade portion toward the inner peripheral side, and a curved inner peripheral end portion connected to the linear portion in a radial direction.

* * * * *